United States Patent [19]

Sedlak et al.

[11] Patent Number: 4,679,944

[45] Date of Patent: Jul. 14, 1987

[54] ELECTRIC WATCH

[75] Inventors: Adlof Sedlak, Wurmberg; Gerhard Stotz, Pforzheim, both of Fed. Rep. of Germany

[73] Assignee: Timex Corporation, Waterbury, Conn.

[21] Appl. No.: 863,751

[22] Filed: May 16, 1986

[30] Foreign Application Priority Data

Mar. 6, 1985 [DE] Fed. Rep. of Germany ..... 3519876

[51] Int. Cl.[4] ..... G04F 5/00

[52] U.S. Cl. ..... 368/157; 368/160; 310/49 R

[58] Field of Search ..... 310/49, 86; 368/157, 368/160, 88

[56] References Cited

U.S. PATENT DOCUMENTS 4,426,158 1/1984 Müller et al. ..... 368/160

FOREIGN PATENT DOCUMENTS 60877 5/1980 Japan ..... 368/88

*Primary Examiner*—Bernard Roskoski

*Attorney, Agent, or Firm*—William C. Crutcher

[57] ABSTRACT

The invention relates to an electric watch, wherein the rotor of a stepping motor is arranged between the metal frame and the plastic frame and is mounted in bearing holes of these frames or base plates. In accordance with the invention, the plastic frame has adjacent to the bearing hole of the rotor a partially cylindrical web extending substantially perpendicular to the metal frame and penetrating the air gap between the rotor and the stator of the stepping motor, while the stator with the associated coil is mounted on the outer side of the plastic frame. This construction enables assembly of the rotor without the effects of disturbing magnetic interaction between rotor and stator tending to dislocate the rotor.

3 Claims, 2 Drawing Figures

ELECTRIC WATCH

BACKGROUND OF THE INVENTION

The invention relates to an electric watch comprising a metal frame, a plastic frame, a stepping motor including a rotor and a stator with an associated coil, and a watch movement driven by the rotor of the stepping motor, wherein wheels of the watch movement and the rotor are arranged in bearing holes of these frames.

In the assembly of such watches, the standard procedure is to first insert one shaft end of various wheels of the watch movement and also one shaft end of the rotor—more strictly speaking: the rotor arrangement—of the stepping motor into the bearing holes of the metal frame provided for this purpose, and to then position the plastic frame on the thus obtained arrangement in such a way that the respective other shaft ends of the wheels of the watch movement and of the rotor enter the bearing holes of the plastic frame provided for this purpose. The plastic frame is then usually screwed to the metal frame, with the spacing between plastic frame and metal frame generally being determined by spacers which are already fixedly connected to the metal frame during assembly and which are provided at their free end with a threaded bore. In this way, the respective wheels of the watch movement, the rotor and, in accordance with the state of the art, also the stator of the stepping motor are secured in the desired position between the two frame elements.

Disadvantageous in the assembly of electric watches with the above-described frame construction is the occurrence between the permanent maget rotor and the magnetic stator of strong magnetic forces with the tendency to tilt the rotor in the direction of the fixed stator, whereby the free shaft end of the rotor is displaced in such a way that the plastic frame may no longer be readily positioned on the free shaft ends of the rotor. This renders assembly of the plastic frame more difficult and more expensive. There is also the danger that an assembler may press the plastic frame onto the shaft ends so that one or the other shaft becomes bent and/or one or several bearing holes are inadmissibly deformed, which means that the watch concerned has to be discarded later as a reject or repaired in a complicated manner, which increases the overall manufacturing costs accordingly.

One object underlying the invention is to so improve an electric watch of the type referred to above so that trouble-free assembly of the plastic frame is possible and the risk of assembly errors is reduced to a minimum.

SUMMARY OF THE INVENTION

Briefly stated, the invention comprises an improved watch in which the plastic frame has adjacent to the bearing hole of the rotor a web extending substantially perpendicular to the metal frame and penetrating the air gap between the rotor and the stator of the step motor, and in that the stator with the associated coil is mounted on the outer side of the plastic frame. Preferably the web is partially cylindrical.

An important advantage of the watch according to the invention is that on account of the fact that the associated stator is not mounted on the outer side of the plastic frame until the latter, with the rotor, has already been assembled, the rotor is not dislocated, during the positioning of the plastic frame onto the various shaft ends, by any magnetic forces which might cause lateral tilting of the rotor. The plastic frame with the bearing holes provided therein is therefore positionable in a trouble-free manner onto the free shaft ends of the wheels of the watch movement and the rotor. This results in an increase in the overall assembly speed and in a clear reduction in the rate of rejects.

On the other hand, the inventive solution of the bearing of the rotor shaft in the metal frame, on the one hand, and in the plastic frame, on the other hand, is distinctly less expensive and simpler than the previously known solutions wherein the rotor is borne in its own small housing arrangement which is inserted into an opening of the stator, as is described, for example, in U.S. Pat. No. 4,412,144.

In a further development of the invention, it has proven advantageous for the web of the plastic frame to be of complementary or matching shape on its outer side to an associated stator opening since, in this case, the web may simultaneously serve as positioning element during assembly of the stator.

DRAWINGS

Further details and advantages of the invention shall be explained in further detail with reference to drawings, in which FIG. 1 shows a partial plan view of the rear side of the watch movement of a watch according to the invention facing the bottom of the casing in a watch which has been completely assembled; and FIG. 2 shows an elevation drawing in cross-section of the watch movement according to FIG. 1, taken along the line 2—2 in that figure.

DESCRIPTION OF THE PREFERRED EMBODIMENT

Figure 1:
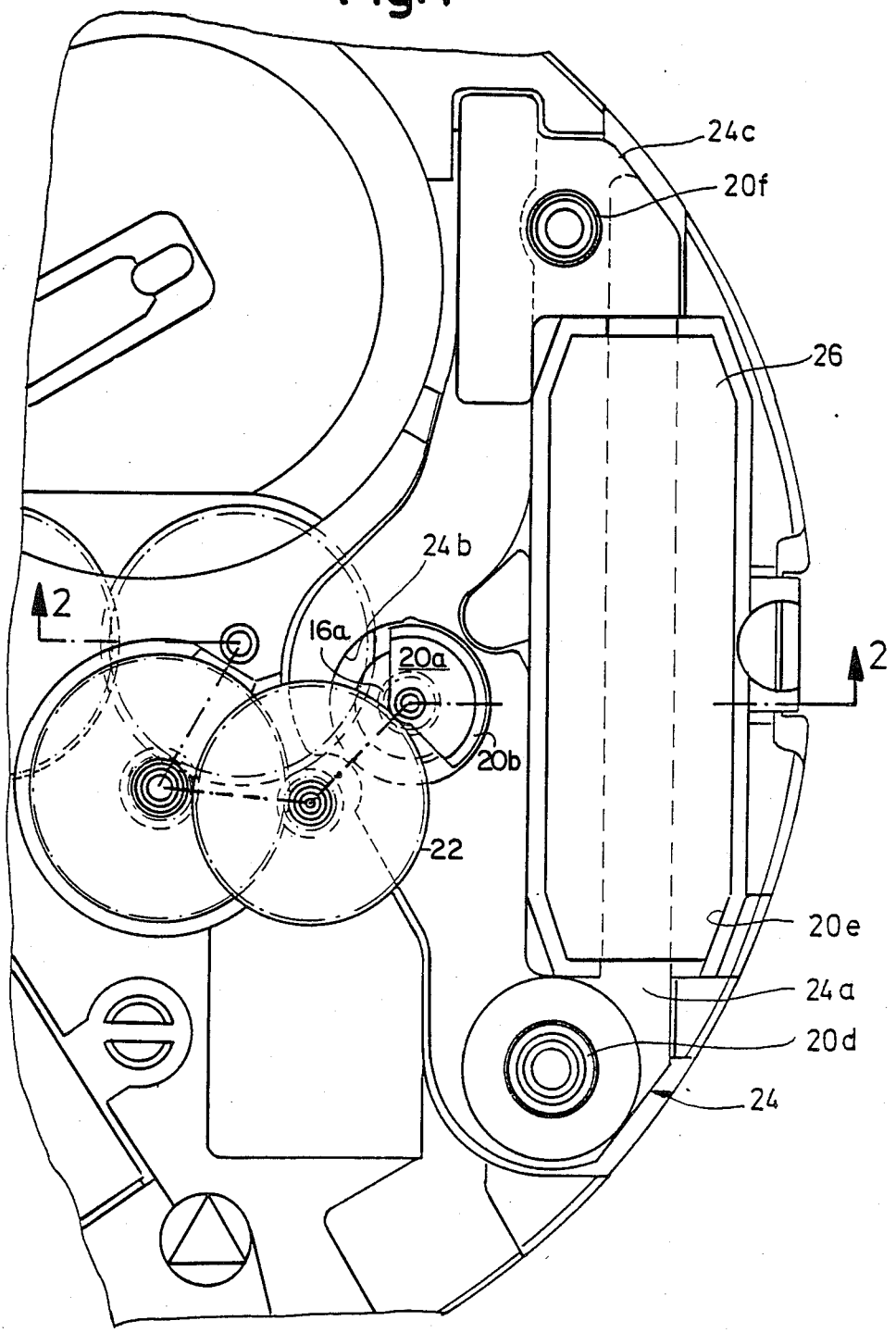
Figure 2:
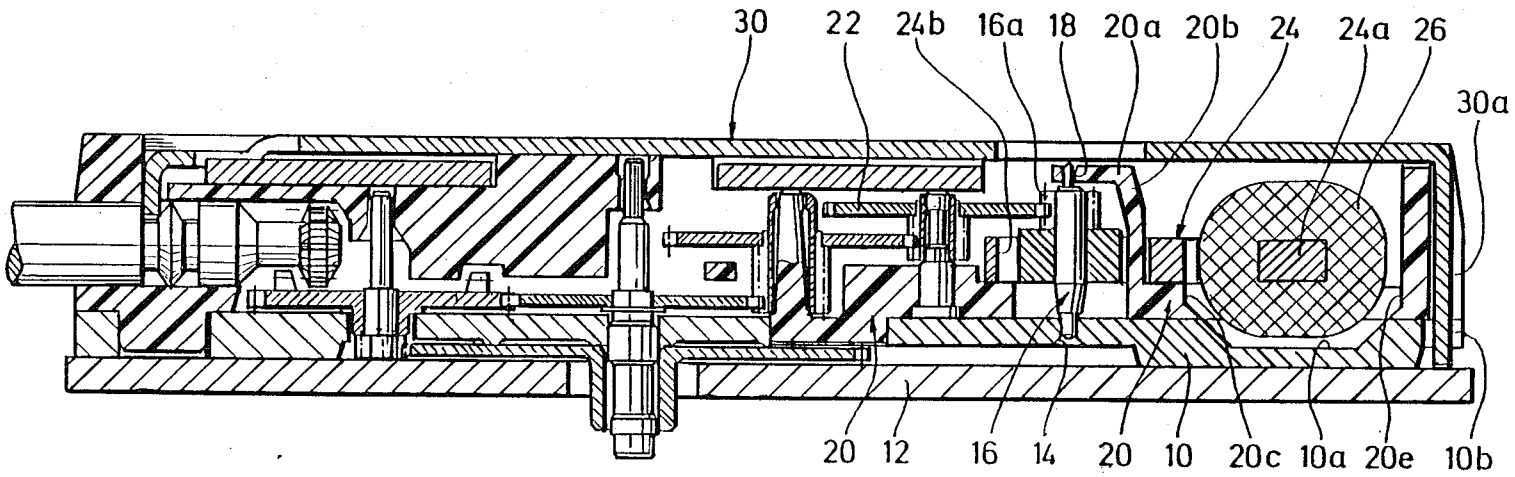

It is apparent from FIGS. 1 and 2 that the base element of the watch movement of a watch according to the invention is a metal frame 10, on whose front side or outer side a dial 12 is disposed, for example, secured by means of small feet. The metal frame 10 comprises a bearing hole 14 for the bottom or front shaft end of a rotor 16 and also further bearing holes, not illustrated in FIG. 2, which are provided for wheels of the watch movement. The rear or upper shaft end of the rotor 16 is mounted in a bearing hole 18 of a plastic frame 20 which has adjacent to the bearing hole 18 and extending parallel to and spaced from the metal frame 10 a platelike portion **20*a* which in the plan view according to FIG. 1 extends through an angle of approximately 150° in relation to the rotor axis. Plate portion 20*a* is connected at its outer edge via a partially cylindrical web 20*b* bent an angle in the vertical direction, or perpendicular, to a portion 20*c* of the plastic frame 20 directly abutting the rear side or the upper side of the metal frame 10. The platelike portion 20*a*, the web 20*b* and the portion 20*c* of the plastic frame abutting the metal frame 10 form a casing element which is open at one side, in FIGS. 1 and 2 to the left, which provides a secure bearing for the inner shaft end of the rotor 16. On the open side of this housing element, a pinion 16*a* of the rotor 16 engages an intermediate gear 22 of the watch movement which is driven by the rotor 16**.

The rotor is a component of a stepping motor comprising a stator 24. The stator 24 comprises a core **24*a* with a free end, which enables a coil 26 to be pushed onto this core 24*a* from the free end of the core 24*a*. The stator 24 further comprises an opening 24*b* which is of such dimensions that the stator 24 may be positioned onto the already assembled plastic frame 20 from the rear or in FIG. 2 from above, in such a way that the opening 24***b* accommodates, on the one hand, the rotor 16 and, on the other hand, also the web 20*b* of the plastic frame 20. The web 20*b* therefor lies in the air gap between the rotor 16 and the stator 24. Since the stator 24 of the watch according to the invention is not mounted until the plastic frame has been assembled, no problems occur in the assembly of the plastic frame 20 on account of a magnetic interaction between the rotor 16 and the stator 24. On the contrary, the magnetic field between rotor 16 and stator 24 does not become effective until both shaft ends of the rotor 16 have already been brought into a secure bearing position.

As previously mentioned, the stator 24 is positioned in relation to the plastic frame 20, on the one hand, by the web 20*b* and, on the other hand, as is apparent from FIG. 1, with the aid of a peg-shaped projection 20*d* on the rear side or on the outer side of the plastic frame 20. The coil 26 lies in an elongated recess 20*e* of the plastic frame and also partly in a recess 10*a* of the metal frame 10 provided for this purpose. A further peg-shaped projection 20*f* of the plastic frame 20 serves to position a bridge element 24*c* which magnetically bridges a gap adjoining the free end of the core 24*a* and enables the coil 26 to be pushed on.

In the watch according to the invention, the connection between the metal frame 10 and the plastic frame 20 may, in principle, be made in a conventional manner by means of screws, as was explained at the outset. Special structural and manufacturing advantages are, however, to be gained by the aforementioned and possibly further components of the watch movement being held together by a spring clip 30 comprising several legs 30*a* bent at an angle, which engage slits 10*b* of the metal frame 10 and are interlockable with the metal frame 10 by means of laterally formed projections (not illustrated) in the area of the slits 10*b*. For reasons of clarity, the spring clip 30 is not illustrated in FIG. 1.

Finally, with reference to the terminology used in the application, it is pointed out that the designations "metal frame" and "plastic frame" were selected so as to compy with the English terminology, whereas the classical designations for the aforementioned components are, in general, "metal base plate" or "metal plate" and "plastic base plate".

What is claimed is:

1. In an electric watch comprising a metal frame, a plastic frame, a stepping motor including a rotor and a stator with an associated coil, and a watch movement driven by said rotor of said stepping motor, said rotor being journaled at opposite ends between said metal frame and said plastic frame, the improvement comprising a web on said plastic frame extending substantially perpendicular to the metal frame and penetrating the air gap between said rotor and said stator of said stepping motor, a platelike portion attached to said web and jourlaling one end of said rotor said stator with the associated coil being mounted on the outer side of said plastic frame.

2. The improvement according to claim 1, wherein said stator defines a substantially circular opening for the rotor and wherein said web of said plastic frame is of complementary arcuate shape on its outer side to fit within said stator opening.

3. The improvement according to claim 1, wherein said web is partially cylindrical.

* * * * *